United States Patent [19]

Setterberg, Jr.

[11] Patent Number: 4,913,228

[45] Date of Patent: Apr. 3, 1990

[54] DUAL STRING TENSION-SET, TENSION-RELEASE WELL PACKER

[75] Inventor: John R. Setterberg, Jr., Victoria, Tex.

[73] Assignee: Otis Engineering Corporation, Dallas, Tex.

[21] Appl. No.: 846,929

[22] Filed: Apr. 1, 1986

Related U.S. Application Data

[63] Continuation-in-part of Ser. No. 802,528, Nov. 27, 1985, abandoned.

[51] Int. Cl.[4] ..... E21B 33/122

[52] U.S. Cl. ..... 166/118; 166/119; 166/134; 166/313; 166/387

[58] Field of Search ..... 166/313, 380, 382, 387, 166/134, 191, 196, 217, 138, 118, 73, 97.5, 242, 113–116

[56] References Cited

U.S. PATENT DOCUMENTS

| | | | |
|---|---|---|---|
| 2,999,544 | 9/1961 | Conrad et al. | 166/313 |
| 3,094,168 | 6/1963 | Myers | 166/118 |
| 3,167,127 | 1/1965 | Sizer | 166/120 |
| 3,170,518 | 2/1965 | Brown | 166/313 |
| 3,198,254 | 8/1965 | Wise et al. | 166/313 |
| 3,326,292 | 6/1967 | Young et al. | 166/106 |
| 3,330,360 | 7/1967 | Young | 166/179 |
| 3,335,800 | 8/1967 | Myers | 166/119 |
| 3,336,983 | 8/1967 | de Rochemont | 166/118 |
| 3,357,489 | 12/1967 | Brown | 166/313 |
| 4,403,654 | 9/1983 | Haynes | 166/73 |
| 4,413,677 | 11/1983 | Perkins | 166/55.1 |
| 4,457,369 | 7/1984 | Henderson | 166/125 |

OTHER PUBLICATIONS

Otis Engineering Corporation Drawing 12DTS7000.
Page Describing Otis DTS Dual Tension Packer.
1980–81 Composite Catalog pp. 5970 & 5971.

*Primary Examiner*—Hoang C. Dang
*Attorney, Agent, or Firm*—Thomas R. Felger

[57] ABSTRACT

A dual string well packer which is anchored at a downhole location within the bore of a well casing string by relative longitudinal movement between the primary tubing string and the secondary tubing string. The well packer is set by applying tension via the secondary string. The well packer is released from its downhole location by applying tension via the primary string. The invention is particularly adapted for use in well completions that are subject to thermocycling such as steam injection wells. However, the anchoring and releasing mechanism of the present invention can be readily adapted for use with any dual string well packer. The present invention includes an improved method for well completion, minimizing tubing handling requirements during the installation and removal of the production tubing strings and associated dual string well packer.

14 Claims, 6 Drawing Sheets

DUAL STRING TENSION-SET, TENSION-RELEASE WELL PACKER

This is a continuation-in-part application based on my earlier patent application Ser. No. 802,528 filed on Nov. 27, 1985 now abandoned.

BACKGROUND OF THE INVENTION

1. Field of the Invention

This invention relates to a well packer for forming a fluid barrier between the interior of a casing string and the exterior of a pair of tubing strings. 2. Description of Related Art It is common practice in the oil and gas industry to use well packers in the bore of a well around the well tubing to seal the annulus between the well tubing and the well bore wall for isolating one or more vertical portions of the well bore. The well bore wall is usually defined by a casing string. Well packers are used in testing, treating and producing wells and in disposal well applications. These various and diverse systems employing well packers involve a wide range of depths at which the packers are used, environments which may produce extremes of high temperature and pressure as well as corrosive fluids, brine solutions, water, steam and other natural formation fluids and fluids used in treating and producing wells. The high cost of running, setting and pulling packers in wells which require handling equipment at the surface as well as substantial periods of shut-down time makes it highly desirable to use packers capable of relatively simple set and release within the well bore. It is particularly desirable for such a packer to be simple in construction with a minimum number of parts.

Well packers for directing fluid flow through a pair of tubing strings have been used for many years. Examples of prior dual string well packers are shown in U.S. Pat. No. 3,094,168 to W. D. Myers; U.S. Pat. No. 3,167,127 to P. S. Sizer; U.S. Pat. No. 3,326,292 to C. R. Young et al; and U.S. Pat. No. 3,336,983 to J. F. De Rochemont. These patents disclose various methods for completing wells with dual tubing strings and various methods for installing and releasing a dual well packer. U.S. Pat. No. 3,198,254 to E. H. Wise et al and U.S. Pat. No. 3,335,800 to W. D. Myers are particularly relevant to the present application because both patents disclose a dual string well packer which is set and released by longitudinal movement of the tubing strings relative to each other. The above listed patents are incorporated by reference for all purposes within this application.

SUMMARY OF THE INVENTION

The present invention includes a method for relatively simple installation and removal of dual production tubing strings from a well bore. An important feature of the invention is a dual string well packer which is releasably anchored downhole in the well bore by applying tension to one tubing string. The dual string well packer is released and retrieved from the well bore by applying tension to the other tubing string.

One object of the present invention is to provide a dual string well packer which can be installed at a downhole location by relative longitudinal movement between the primary tubing string and the secondary tubing string.

Another object of the present invention is to provide a well packer which can be released from its downhole position by longitudinal movement of the primary string after removing the secondary string.

A further object of the present invention is to provide a dual string well packer which can be set with tension but does not require tension or compression forces from the associated tubing strings to remain set at a downhole location.

An additional object of the present invention is to provide a dual string well packer which is installed by lowering the well packer on a primary or long string to the desired downhole location. A secondary or short string is engaged with the packer and tension applied by pulling on the secondary string to set the packer. An important advantage of the present invention is that only limited force is applied to the primary string during the setting operation.

A further object of the present invention is to provide a dual string well packer which is adapted for use in well completions which are subject to changes in temperature such as steam injection wells. The well packer is particularly useful in conjunction with a travel joint and polished bore receptacle to compensate for the effects of heat-up and cool-down of the primary and secondary tubing strings. These temperature changes typically occur when steam injection is started and stopped.

Another object of the present invention is to provide a dual string mechanically set well packer that maintains the setting force applied to the packing means.

Another object of the present invention is to provide a dual string mechanically set well packer that isolates injected or produced well fluids from the set and release mechanisms.

Additional objects and advantages of the present invention will be readily apparent to those skilled in the art from reading the following description in conjunction with the drawings and claims.

DESCRIPTION OF THE PREFERRED EMBODIMENTS

Figure 1:
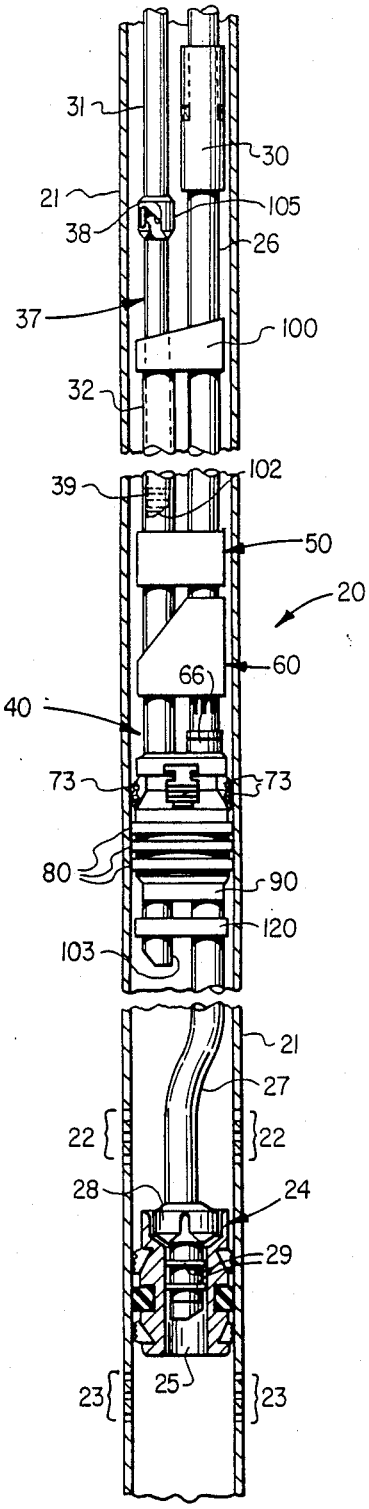
FIG. 1 is a longitudinal schematic view partially in section and partially in elevation showing a well completion incorporating the dual string well packer and other components of the present invention.

FIG. 1 is a schematic representation of a portion of well 20 completed in accordance with the teachings of the present invention. The invention will be described with respect to an oil well which uses steam injection to reduce the viscosity and improve the production flow rate from a heavy hydrocarbon producing formation. However, the present invention including dual string well packer 40 could be used to complete various types of wells including oil, gas or geothermal.

Well 20 is defined in part by casing string 21 which extends from the well surface (not shown) to one or more downhole hydrocarbon producing formations (not shown). Perforations 22 extend through casing 21 to allow fluid communication with an upper producing formation adjacent thereto. Perforations 23 extend through casing 21 to allow fluid communication with a lower producing formation adjacent thereto. Well packer 24 is disposed within casing 21 between perforations 22 and 23 to prevent undesired commingling of formation fluids within casing 21. Various types of packers are commercially available for use as well packer 24. One packer satisfactory for use with this invention is shown in U.S. Pat. No. 4,457,369 to William D. Henderson. Well packer 24 is sometimes referred to as a single string packer because it has only one fluid flow path defined by bore 25 extending therethrough. Well packer 40 will be referred to as a dual string well packer because it has two parallel longitudinal flow passageways or bores 43 and 44 extending therethrough.

Packer 24 is set or anchored within casing 21 by suitable means such as a wire line or a working string between perforations 22 and 23. Next, primary or first tubing string 26 with well packer 40 attached thereto is lowered into the well bore defined in part by casing 21. Packer 40 is in its first or running position as shown in FIGS. 3A-3D during this time.

A portion of tubing string 26, designated as tailpipe 27, extends downwardly from packer 40. The extreme end of tailpipe 27 carries an appropriately sized stop collar 28 and seal means 29 to engage bore 25 and form a fluid barrier therewith. The length of tailpipe 27 is selected to ensure that packer 40 is spaced above perforation 22 when seal means 29 engage bore 25 of packer 24. During no flow conditions, stop collar 28 should preferably be spaced a sufficient distance above packer 24 to accommodate thermal expansion tailpipe 27 when hot fluids flow therethrough. The spacing is selected to ensure that seal means 29 maintain a fluid barrier with bore 25 during thermal cycling and to protect packer 24. An expansion or travel joint 30 is preferably included with tubing string 26 above packer 40. Tubing string 26 provides fluid communication between the well surface and the formation adjacent to perforations 23 via bore 25, tailpipe 27, longitudinal flow passageway 44 through packer 40 and expansion joint 30.

Figure 7:
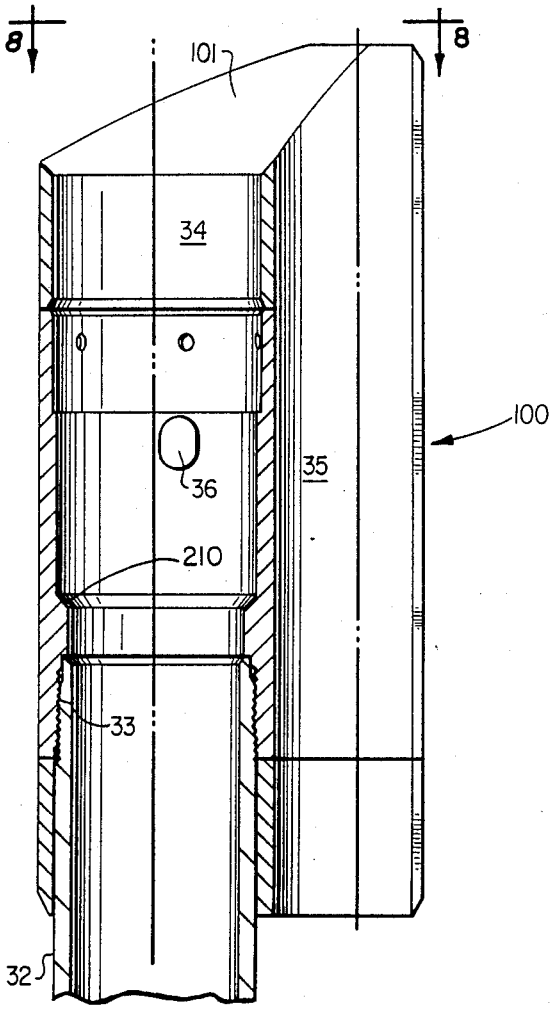
FIG. 7 is a drawing in longitudinal section of the tubing string guide assembly used to connect the primary string with the secondary string to allow relative longitudinal movement therebetween.
Figure 8:
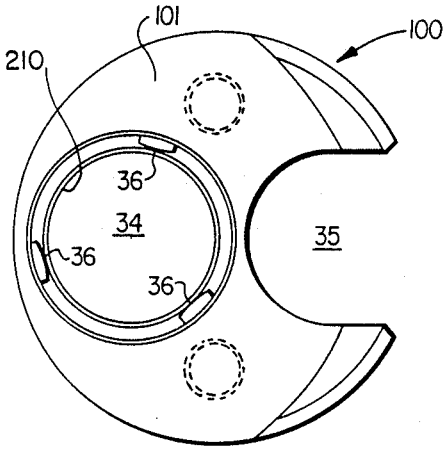
FIG. 8 is an end view taken along line 8—8 of FIG. 7.
Figure 10:
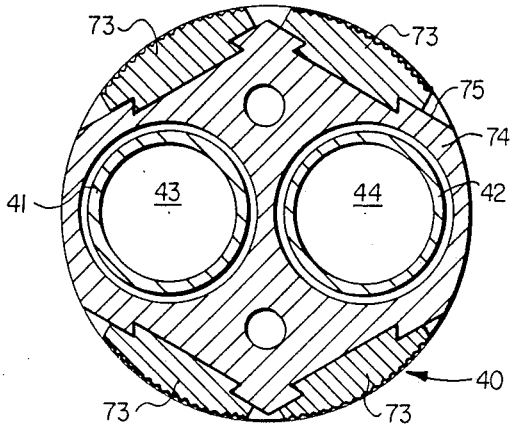
FIG. 10 is a drawing in section taken along line 10—10 of FIG. 3B.

After positioning well packer 40 at the desired downhole location, second tubing string 31 is inserted into casing 21 from the well surface. Second tubing string 31 is considerably shorter in length as compared to primary tubing string 26. Tubing string guide assembly 100 is positioned above packer 40 by polished bore receptacle 32. Guide assembly 100 is sometimes referred to as a dual scoop head. Polished bore receptacle 32 is an extension of mandrel means 41 of well packer 40. Guide assembly 100 is securely engaged to receptacle 32 by threaded connection 33. Guide assembly 100 as best shown in FIGS. 7 and 8 has two parallel openings 34 and 35 extending longitudinally therethrough. Opening 34 includes a plurality of lugs 36 which project radially inward and are sized to releasably engage tubing string 31. Opening 35 has a C-shaped cross section and is sized to allow tubing string 26 to slide longitudinally therethrough without restriction. Conical guide surface 101 is provided on the top of assembly 100 to direct tubing string 31 into opening 34.

Seal assembly 37 is carried on the lower end of tubing string 31. The main components of seal assembly 37 comprise coupling 105 with external J-slots 38 sized to releasably secure lugs 36 therein, seal means 39, and chamfer 102 on the extreme end thereof. Seal means 39 are selected to provide a longitudinally movable fluid barrier with the interior of receptacle 32 adjacent thereto. Chamfer 102 cooperates with guide surface 101 to ease the installation of second tubing string 31 into opening 34. A relatively short tailpipe 103 extends downwardly from well packer 40 to direct fluid flow into longitudinal flow passageway 43.

Temporary engagement of lugs 36 with J-slot 38 allows tension forces applied by secondary tubing string 31 to set or anchor well packer 40 within casing 21. Well packer 40 will be described later in detail. J-slot 38 is preferably released from lugs 36 after setting packer 40 to allow longitudinal movement of tubing string 31 relative to polished bore receptacle 32. Fluid communication is then possible between the well surface and the formation adjacent to perforations 22 via tubing string 31, receptacle 32, longitudinal flow passageway 43 through packer 40 and tailpipe 103.

The 1980-81 Composite Catalog of Oil Field Equipment and Services shows a seal assembly on page 5970 and tubing travel joints on page 5971 satisfactory for use with the present invention. The various seal means should be selected from elastomeric and copolymer compounds compatible with steam injection or other fluids flowing through tubing strings 26 and 31.

During installation of well packer 40, expansion joint 30 is releasably held in its fully extended position. Thus, when steam is injected through tubing string 26, expansion joint 30 can compensate for expansion of tubing string 26 without applying excessive force to well packer 40. When steam injection is stopped, expansion joint 30 allows for contraction of tubing string 26 without disturbing the engagement of packer 40 with casing 21. In a similar manner, tubing string 31 is preferably positioned with seal assembly 37 only partially inserted into polished bore receptacle 32 during no flow condition. Thus, expansion of tubing string 31 resulting from heating during steam injection can be compensated for by longitudinal movement of seal means 39 within receptacle 32.

An important feature of the present invention is the relative ease with which tubing strings 26 and 31 and well packer 40 can be removed from the well bore. As shown in FIG. 1, during normal operation, tubing string 31 is slidably disposed within receptacle 32. Therefore, tubing string 31 can be removed by straight upward pull at the well surface. Well packer 40 is released from its downhole location by upward pull (tension) applied by primary tubing string 26. This same upward movement lifts tailpipe 27 out of engagement with lower packer 24.

Dual String Well Packer 40

Figure 6A:
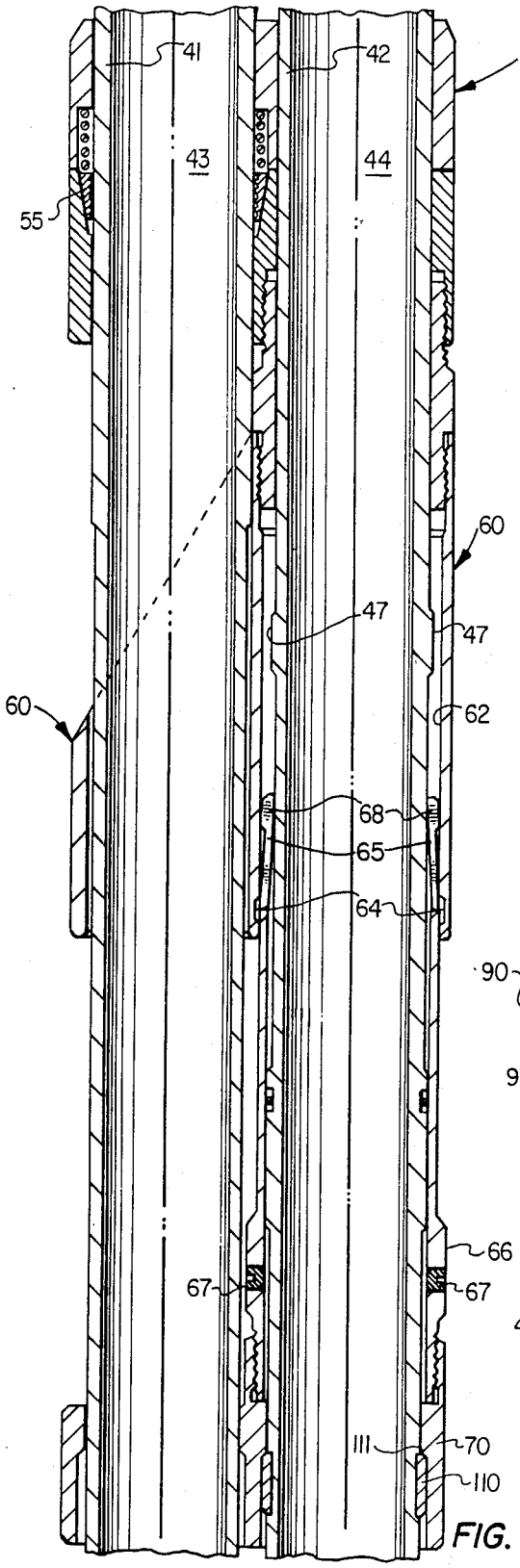
FIGS. 6A and 6B are drawings in longitudinal section of the packer shown in FIGS. 3A–3D as it would appear while being retrieved from a downhole location.
Figure 6B:
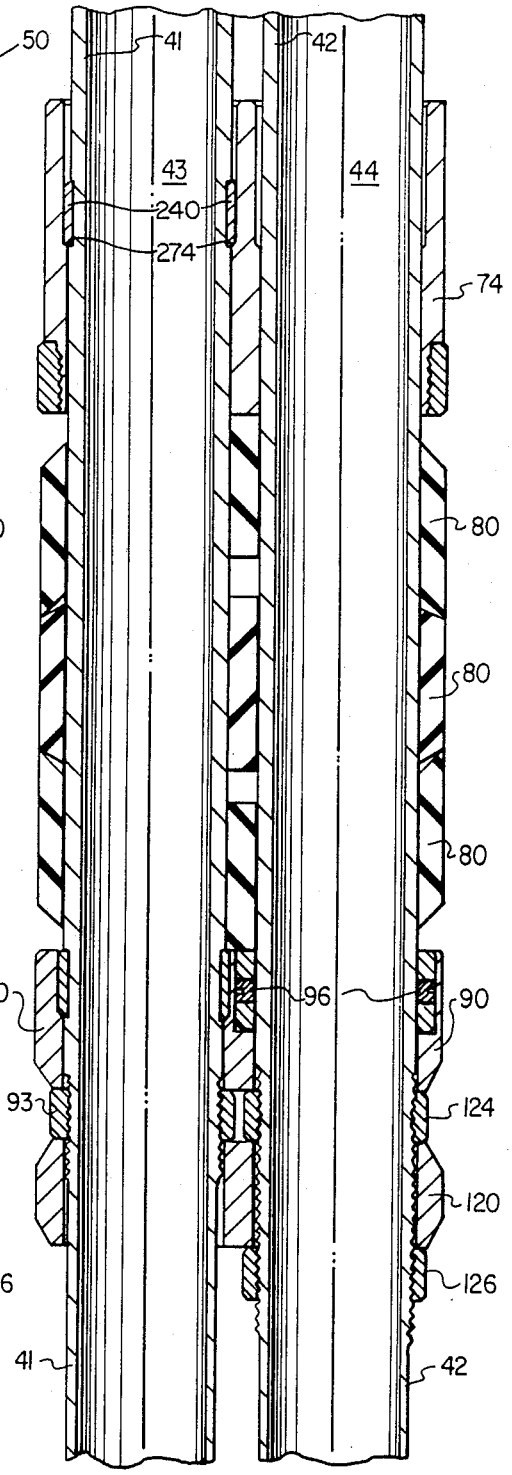

Well packer 40 has three distinct positions which will be described in detail. The first or running position, when well packer 40 is being installed within casing string 21, is shown in FIGS. 2 and 3A–3D. The second or set position, when well packer 40 is releasably engaged with casing string 21, is shown in FIGS. 1 and, 4A and 4B. The third or retrieving position, during removal of well packer 40 from its downhole location, is shown in FIGS. 6A and 6B.

Well packer 40 has a pair of parallel mandrel means 41 and 42 with longitudinal flow passageways 43 and 44 extending respectively therethrough. The various components and elements which comprise well packer 40 are attached to or carried by mandrel means 41 and 42. Couplings 45 and 46 are attached by threaded connections to the upper end of mandrel means 41 and 42 respectively. Coupling 45 provides means for attaching polished bore receptacle 32 to mandrel means 41. Coupling 46 provides means for attaching first tubing string 26 to mandrel means 42. As previously noted, second tubing string 31 is preferably slidably disposed within receptacle 32 when well packer 40 is set and steam is injected through longitudinal flow passageway 43.

Internal slip housing means 50 is carried by and surrounds both mandrel means 41 and 42. For ease of manufacture and assembly, housing means 50 consists of two generally cylindrical subassemblies 50*a* and 50*b* which are connected together by bolts (not shown). Parallel bores 51 and 52 extend through both subassemblies 50*a* and 50*b* with mandrel means 41 and 42 slidably disposed respectively therein. Bore 51 has recess 53 formed on its inside diameter. Recess 53 is sized to receive spring 54 and a plurality of internal slips 55 therein. Teeth 56 are provided on the interior of slips 55 to engage the exterior of mandrel means 41 adjacent thereto. The configuration of teeth 56, slips 55 and recess 53 is selected to allow longitudinal movement of mandrel means 41 in one direction (upwardly) relative to housing means 50 and to prevent relative longitudinal movement in the other direction (downwardly). Engagement between slips 55 and mandrel means 41 is used to hold well packer 40 in its set position. Therefore, neither tubing strings 26 nor 31 are required to apply either compressive or tension forces to well packer 40 after it is set. Threads 48 are formed on the exterior of mandrel means 42 spaced longitudinally from upper coupling 46. Nut 49 is engaged with threads 48 to provide a stop shoulder or limit for longitudinal movement of mandrel means 42 in the other direction (downwardly) relative to housing means 50.

Threaded recess 58 is formed in the bottom of bore 52 to allow connection of adapter subassembly 57 to housing 50. Adapter subassembly 57 is a relatively short hollow cylinder that surrounds the exterior of mandrel means 42. One end of adapter subassembly 57 is threadedly engaged with housing means 50 and the other end with collet cylinder 60.

Figure 2:
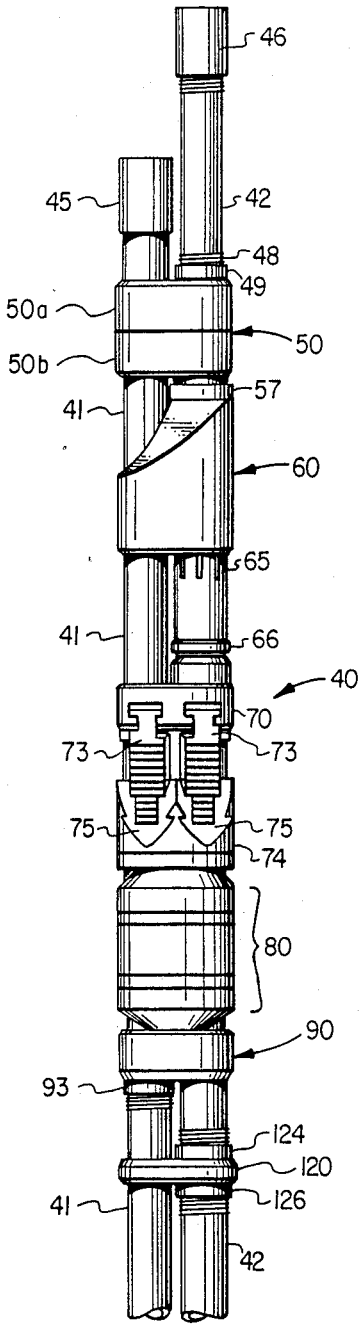
FIG. 2 is a drawing in elevation of a dual string well packer embodying the present invention.
Figure 3A:
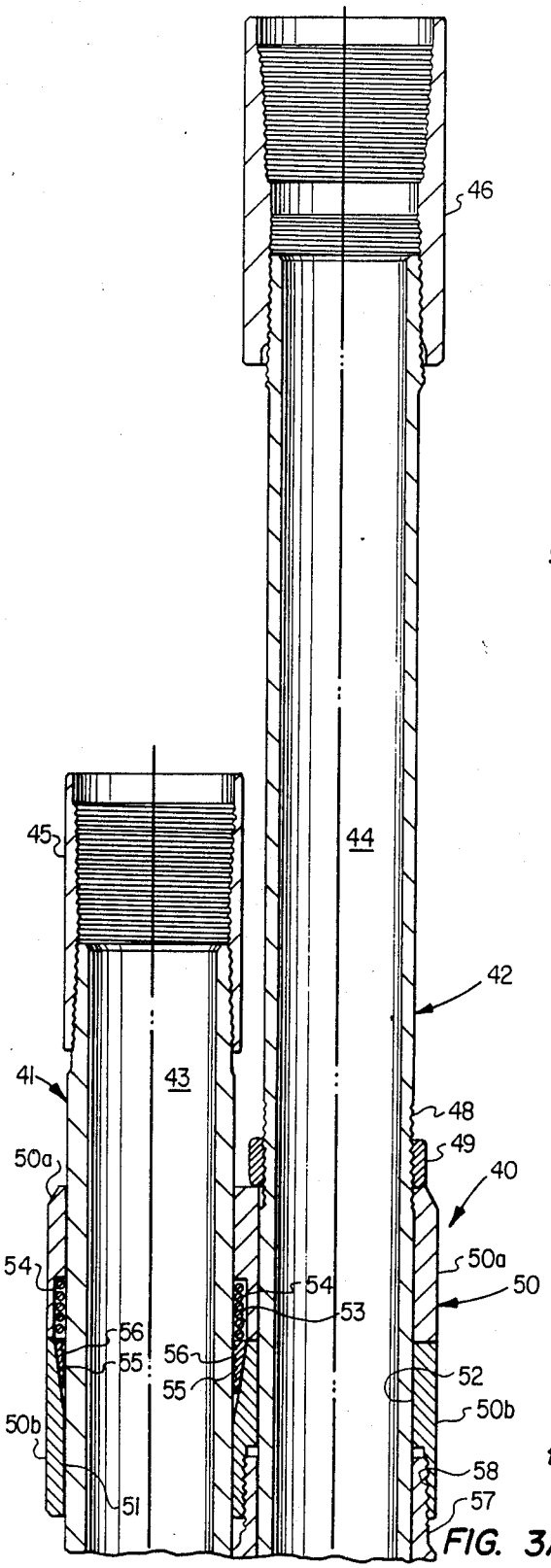
FIGS. 3A–3D are drawings in longitudinal section with portions broken away showing the well packer of FIG. 2 as it would appear prior to installation at a downhole location within a well bore.
Figure 3B:
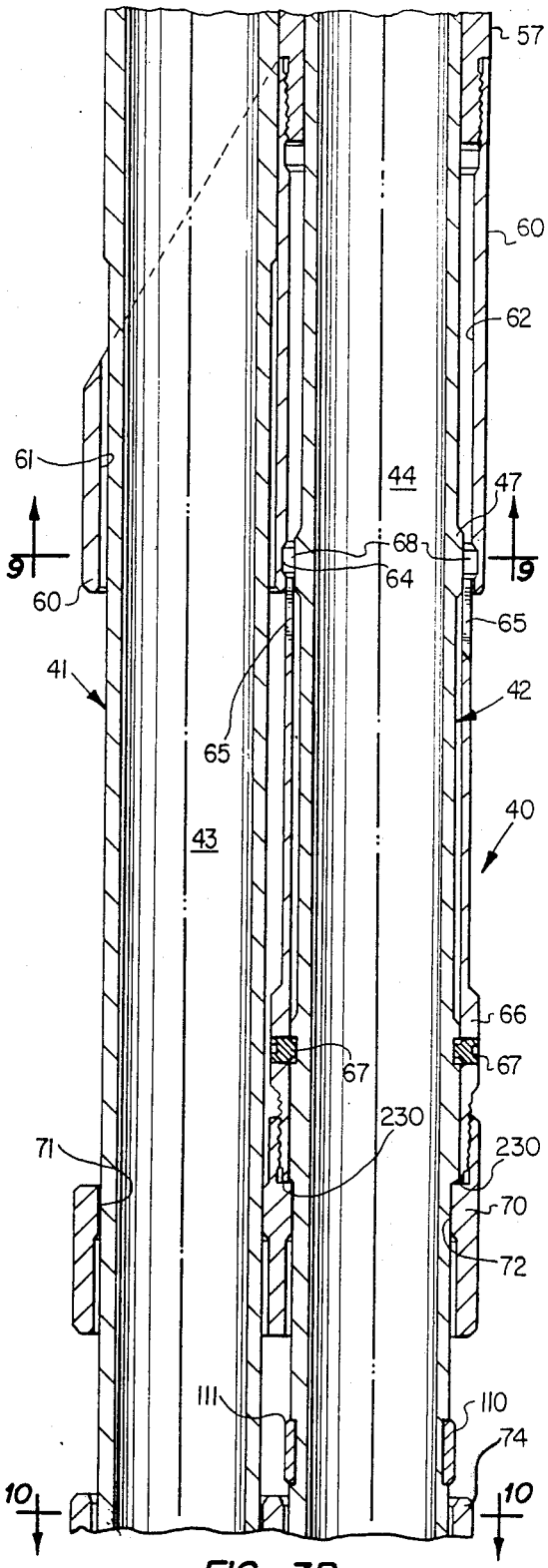
Figure 3C:
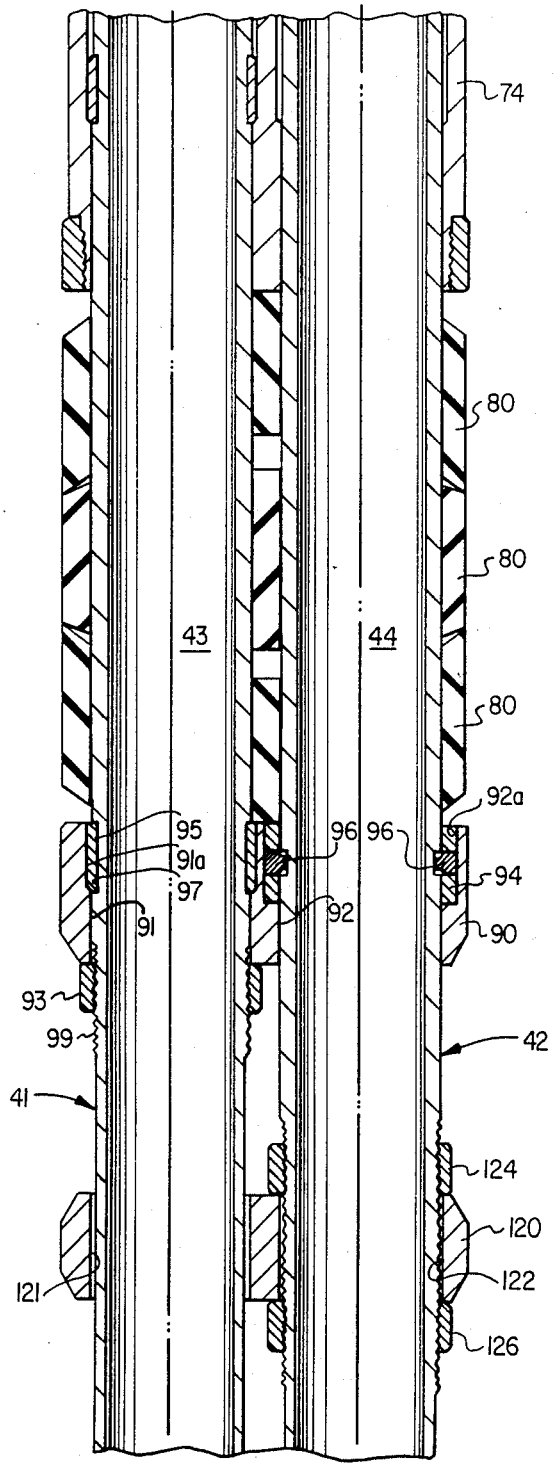
Figure 3D:
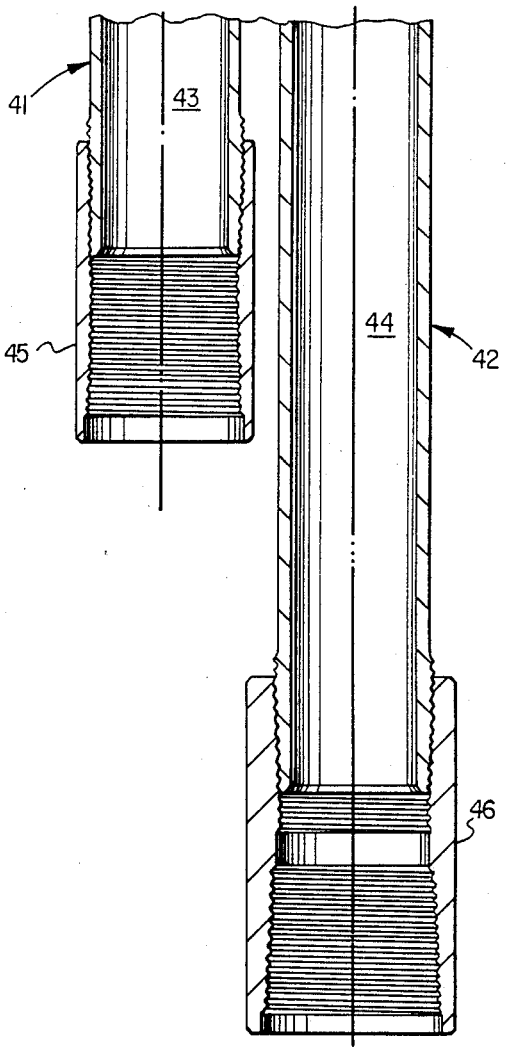
Figure 4A:
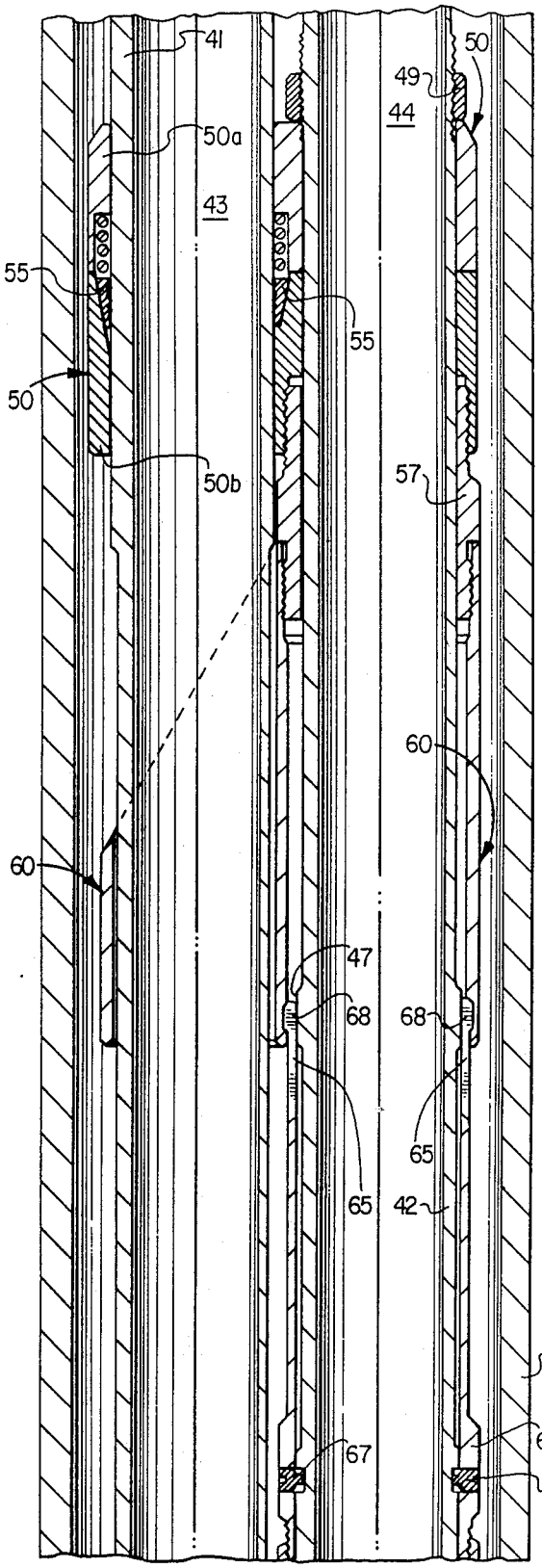
FIGS. 4A and 4B are drawings in longitudinal section with portions broken away showing the packer of FIGS. 3A–3D in its set position.
Figure 4B:
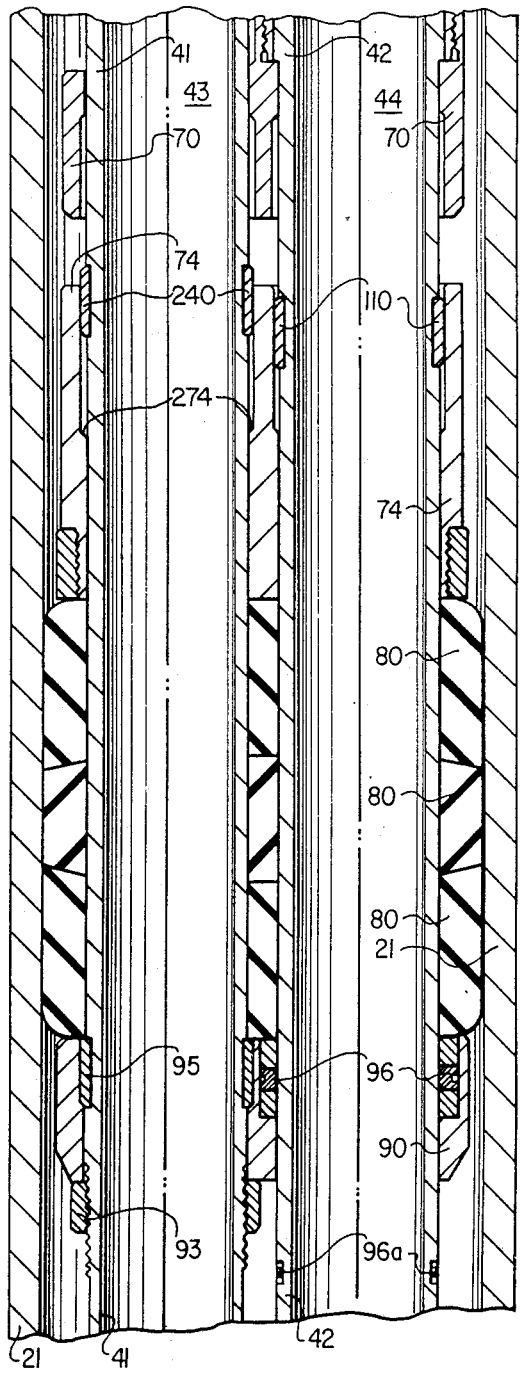

Collet cylinder 60 is formed from a solid, cylindrical body. Two parallel, longitudinal bores 61 and 62 are machined therethrough. Mandrel means 41 and 42 are slidably disposed in bores 61 and 62 respectively. As best shown in FIGS. 2 and by a dotted line in FIG. 3B, a significant portion of cylinder 60 which surrounds mandrel means 41 has been cut away. This material is removed to facilitate the assembly of housing subassemblies 50*a* and 50*b* by bolts (not shown).

Annular recess or groove 64 is formed on the interior of bore 62 near its lower end. A plurality of collet fingers 65 are carried on the exterior of mandrel means 42 by collet ring 66. Collet ring 66 is releasably secured to mandrel means 42 by shear screws 67. Collet head 68 is formed on the end of each collet finger 65 opposite from collet ring 66. Collet heads 68 are sized to fit within groove 64. Mandrel means 42 also has an annular boss or flange 47 on its outside diameter. The longitudinal spacing of boss 47 relative to the engagement of shear screws 67 and the length of fingers 65 is selected so that boss 47 will hold collet heads 68 engaged with groove 64 when boss 47, collet heads 68 and groove 64 are positioned radially adjacent to each other. Cooperation between internal slip housing means 50 and its associated components with collet cylinder 60 and its associated components holds well packer 40 releasably set within casing string 21.

Figure 5:
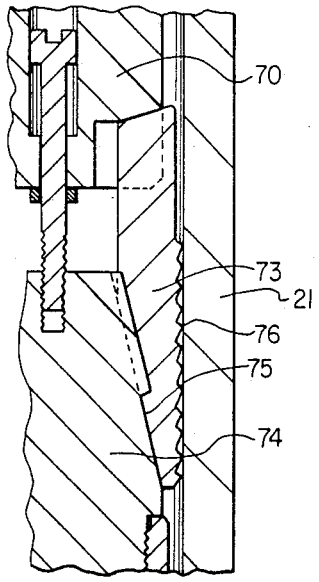
FIG. 5 is an enlarged fragmentary view in section showing the engagement of the slips carried by the well packer of FIG. 2 with well casing at a downhole location.
Figure 9:
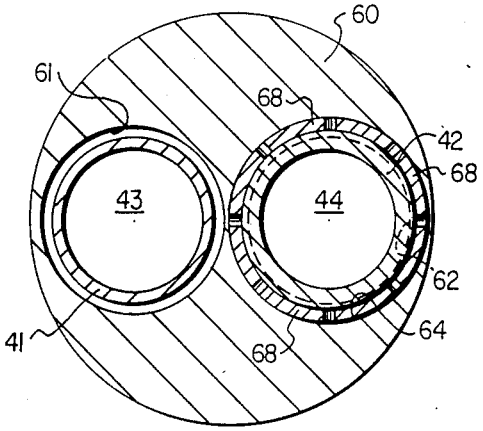
FIG. 9 is a drawing in section taken along line 9—9 of FIG. 3B.

Slip carrier 70 is a generally solid, cylindrical member carried on the exterior of mandrel means 41 and 42 adjacent to collet ring 66. Slip carrier 70 has two bores 71 and 72 with mandrel means 41 and 42 slidably disposed respectively therein. Conventional dovetail packer slips 73 are carried by slip carrier 70. Slips 73 have teeth 76 which can bite into the inside diameter of casing 21 as shown in FIG. 5.

Slip expander 74 is carried on the exterior of mandrel means 41 and 42 and is longitudinally slidable towards slip carrier 70. The exterior of slip expander 74 includes tapered, conical surface 75 which projects slips 73 radially outward to engage the inside diameter of casing 21. Slip carrier 70, slips 73 and slip expander 74 comprise means for anchoring well packer 40 within casing 21.

A plurality of packing means 80 are carried on the exterior of mandrel means 41 and 42. Packing means 80 can be manufactured from various elastomeric or polymeric compounds based on downhole well conditions and formation fluids. Examples of such compounds are ethlene propylene-diene terpolymer (EPDM), vinylidene fluoride, hexafluoropropylene copolymer, laminated carbon ribbon packing (Grafoil, a registered trademark of Union Carbide Corporation), asbestos, polytetra fluoro ethylene, and polyphenylene sulfide. These compounds may be reinforced with fiberglass or wire mesh as desired. Packing means 80 is disposed between slip expander 74 and setting collar 90. Setting collar or lower element retainer 90 is generally cylindrical with bores 91 and 92 machined therethrough. Mandrel means 41 and 42 are disposed in bores 91 and 92 respectively. Setting collar 90 is positioned on mandrel means 41 between stop nut 93 and snap ring 95. For ease of manufacture and assembly, snap ring 95 is carried in recess 97 on the exterior of mandrel means 41. A portion of bore 91 has an enlarged inside diameter 91*a* which allows setting collar 90 to slide over snap ring 95 during assembly. Stop nut 93 is then engaged with threads 99 on the exterior of mandrel means 41 to securely trap stop collar 90 between snap ring 95 and nut 93. Thus, setting collar 90 moves longitudinally in unison with mandrel means 41 during running, setting and release of well packer 40.

A portion of bore 92 of setting collar 90 also has an enlarged inside diameter portion 92*a*. Shear pin sleeve 94 is sized to fit within enlarged portion 92*a* between mandrel means 42 and setting collar 90. Shear pins 96 are used to releasably engage shear sleeve 94 to mandrel means 42. During assembly of well packer 40, sleeve 94 is engaged with mandrel means 42, and snap ring 95 is installed into recess 97 of mandrel means 41. Then, mandrel means 41 and 42 are inserted through their respective bores 91 and 92 to position snap ring 95 within enlarged inside diameter portion 91*a* and shear pin sleeve 94 within enlarged inside diameter portion 92*a*. Nut 93 is engaged with threads 99 to firmly secure setting collar 90 to mandrel means 41. Setting collar 90 and its associated components comprise means for releasably securing mandrel means 41 and 42 to each other to prevent relative longitudinal movement therebetween until after well packer 40 is lowered to its desired downhole location.

An important feature of the present invention is that the force applied to mandrel means 42 and tubing string 26 during setting of well packer 40 is limited to the force required to shear pins 96. Expansion joint 30 is preferably held in its fully extended position by shear pins or collets that require greater force than pins 96 to release expansion joint 30.

Retrieving collar 120 is carried on the exterior of mandrel means 41 and 42 spaced longitudinally below setting collar 90. Retrieving collar 120 is generally cylindrical with bores 121 and 122 extending therethrough. Mandrel means 41 is slidably disposed within bore 121 of retrieving collar 120. Mandrel means 42 is disposed within bore 122. Stop nuts 124 and 126 are positioned on mandrel means 42 above and below collar 120 to firmly secure stop collar 120 to mandrel means 42. Thus, retrieving collar 120 moves longitudinally in unison with mandrel means 42 during running, setting and release of well packer 40. Retrieving collar 120 also serves as a gauge ring to prevent any obstructions within casing 21 from contacting setting collar 90 and prematurely setting well packer 40 while being lowered to the desired downhole location.

Coupling means 45 and 46 are provided on the lower end of mandrel means 41 and 42 respectively to attach additional portions of tubing strings 31 and 26 thereto.

Setting or Anchoring Well Packer 40

Primary tubing string 26 with its previously described components including well packer 40 is lowered through casing 21 until stop collar 28 rests on lower well packer 24. Tubing string 26 is then raised to position stop collar 28 the desired distance above well packer 24. Secondary tubing string 31 is next lowered through casing 21. Guide surface 101 directs seal assembly 37 into opening 34 of scoop head 100 and polished bore receptacle 32. Tubing string 31 is lowered until coupling 105 contacts tapered shoulder 210 below lugs 36 preventing further downward movement. Tubing string 31 automatically rotates to the left a sufficient amount to properly position lugs 36 in J-slot 38. Tension from tubing string 31 can now be applied to mandrel means 41 via coupling 105, J-slot 38, lugs 36, scoop head 100 and polished bore receptacle 32. At this same time, tubing string 26 is held at the well surface from moving upwardly.

Tension or upward force from mandrel means 41 is applied to setting collar 90 by stop nut 93. Since tubing string 26 holds mandrel means 42 fixed relative to the other components of well packer 40, this force causes shear screws 96 to part releasing setting collar 90 to slide over the exterior of mandrel means 42. As previously noted, pins or screws 96 are selected to part before expansion joint 30 is released to telescope.

Internal slips 55 permit upward movement of mandrel means 41 relative to internal slip housing 50. Stop nut 49 blocks upward movement of housing means 50 relative to mandrel means 42. Upward movement of mandrel means 41 lifts setting collar 90 into contact with packing means 80 which in turn abuts slip expander 74. Slip carrier 70 is restricted from moving upwardly by annular shoulder 230 provided on the exterior of mandrel means 42 below shear pins 67. See FIG. 3B. Therefore, upward movement of mandrel means 41 and setting collar 90 results in movement of slip expander 74 towards slip carrier 70 which is translated into radial expansion of slips 73 into engagement with the interior of casing 21 as shown in FIG. 5. As tension from secondary tubing string 31 increases, teeth 76 of slips 73 bite deeper into casing 21. However, this increased tension is not applied to mandrel means 42. Therefore, boss 47 maintains collet heads 68 securely engaged with groove 64, and collet ring 66 remains secured by shear pins 67 to mandrel means 42 during the setting operation. Tension is applied to mandrel means 41 until the desired amount of compression and radial expansion has been applied to packing means 80. Tension from secondary tubing string 31 can then be released, and internal slips 55 will bite into mandrel means 41 to hold well packer 40 in its set position. Secondary tubing string 31 and its associated seal assembly 37 are then positioned to allow longitudinal movement of seal assembly 37 within receptacle 32.

Release and Retrieval of Well Packer 40

Tubing string 31 is first removed from casing 21 by straight upward pull at the well surface. Upward tension is next applied to mandrel means 42 by primary tubing string 26. Mandrel means 42 is prevented from moving upward relative to the other components of well packer 40 until enough tension is applied to part shear pins 67. Mandrel means 42 can then move upward to remove boss 47 from behind collet heads 68. Collet heads 68 are thus freed to flex radially inward. Mandrel means 41 is then free to immediately drop downwardly until snap ring 240 engages seating shoulder 274 within slip expander 74. This sharp contact helps to release slips 73 from casing 21. If slips 73 should not release for some reason, tubing string 31 can be reinserted into the well bore to apply extra downward force to release well packer 40. This is a significant advantage of the present invention over prior dual string well packers.

Snap ring 110 is positioned on the exterior of mandrel means 42 to provide a shoulder 111 facing slip carrier 70. Upward movement of mandrel means 42 will result in snap ring 110 contacting slip carrier 70. After collet heads 68 are released from groove 64, collet fingers 65 can telescope into bore 62 of collet cylinder 60 allowing mandrel means 42 via shoulder 111 to lift slip carrier 70. Lifting slip carrier 70 causes slips 73 to move radially inward and releases well packer 40 from casing 21. Compression of packing means 80 is also released by disengaging slips 73 from casing 21.

Continued upward movement of mandrel means 42 results in retrieving collar 120 abutting setting collar 90 as shown in FIG. 6B. Upward movement of mandrel means 42 now causes upward movement of mandrel means 41 and the other components comprising well packer 40. The other components of tubing string 26 are removed from casing 21 by conventional techniques.

Alternative Embodiments

The relationship of slips 73 to slip expander 74 results in well packer 40 primarily resisting fluid pressure forces from below packing means 80. Those skilled in the art will readily appreciate that the arrangement of slip carrier 70, slips 73 and slip expander 74 could be modified to resist fluid pressure forces from above packing means 80. Also, bi-direction slips, well known in the art, could be used in place of slips 73.

Collet cylinder 60 could be replaced by a smaller cylinder that surrounds only mandrel means 42. Collet cylinder 60 is preferred because its size provides for more reliable engagement with groove 64. Other possible alternatives include releasably securing collet heads 68 to a groove, similar to groove 64, machined directly into internal slip housing 50 or shear pinning slip carrier 70 directly to mandrel means 42.

In some applications, retrieving collar 120 could be replaced with only stop nut 124 or a similar shoulder on the exterior of mandrel means 42 spaced longitudinally from setting collar 90.

The engagement of internal slips 55 with the exterior of mandrel means 41 can be improved by machining threads thereon sized to receive teeth 56.

The previous written description describes the preferred embodiments of the present invention. Those skilled in the art will readily see alternative configurations and modifications without departing from the scope of the invention which is defined in the following claims.

What is claimed is:

1. A well packer for forming a downhole fluid barrier between a casing string and a pair of tubing strings disposed therein comprising:

a. a pair of parallel mandrel means with a longitudinal flow passageway extending through each mandrel means;

b. means for connecting each mandrel means to separate tubing strings to allow fluid communication through each mandrel means and its associated tubing string;

c. packing means carried on the exterior of the mandrel means whereby compression of the packing means causes radial expansion thereof to form the fluid barrier between the exterior of the mandrel means and the interior of the casing string;

d. anchoring means carried on the exterior of the mandrel means having a retracted position and an expanded position whereby the anchoring means is releasably engageable with the interior of the casing string to prevent undesired movement of the well packer relative to the casing string;

e. means for releasably securing the mandrel means to each other to prevent relative longitudinal movement therebetween until after the well packer is lowered to its desired downhole location;

f. means for moving the anchoring means to its expanded position and compressing the packing means in response to tension forces applied to one tubing string causing upward longitudinal movement of one mandrel means relative to the other mandrel means; and g. means for moving the anchoring means to its retracted position and releasing compression of the packing means in response to tension forces applied to the other tubing string causing upward longitudinal movement of the other mandrel means relative to the one mandrel means.

2. A well packer as defined in claim 1 wherein the releasable securing means further comprises:

a. a setting collar carried on the exterior of the mandrel means below the packing means;

b. means for firmly engaging the setting collar to the one mandrel means; and c. means for releasably engaging the setting collar to the other mandrel means and releasing the engagement in response to tension forces applied to the one tubing string.

3. A well packer for forming a downhole fluid barrier between a casing string and a pair of tubing strings disposed therein comprising:

a. a pair of parallel mandrel means with a longitudinal flow passageway extending through each mandrel means;

b. means for connecting each mandrel means to separate tubing strings to allow fluid communication through each mandrel means and its associated tubing string;

c. packing means carried on the exterior of the mandrel means whereby compression of the packing means causes radial expansion thereof to form the fluid barrier between the exterior of the mandrel means and the interior of the casing string;

d. anchoring means carried on the exterior of the mandrel means having a retracted position and an expanded position whereby the anchoring means is releasably engageable with the interior of the casing string to prevent undesired movement of the well packer relative to the casing string;

e. means for releasably securing the mandrel means to each other to prevent relative longitudinal movement therebetween until after the well packer is lowered to its desired downhole location;

f. means for moving the anchoring means to its expanded position and compressing the packing means in response to tension forces applied to one tubing string causing upward longitudinal movement of one mandrel means relative to the other mandrel means;

g. means for moving the anchoring means to its retracted position and releasing compression of the packing means in response to tension forces applied to the other tubing string causing upward longitudinal movement of the other mandrel means relative to the one mandrel means;

h. internal slip housing means;

i. both mandrel means slidably disposed within the housing means;

j. internal slips carried by the housing means to engage the exterior of the one mandrel means; and k. the housing means and its internal slips cooperating to allow only upward longitudinal movement of the one mandrel means relative to the other mandrel means.

4. A well packer as defined in claim 3 wherein the anchoring means further comprises:

a. slips to engage the casing string;

b. a slip carrier with both mandrel means slidably disposed therethrough;

c. a slip expander with both mandrel means slidably disposed therethrough and longitudinally spaced from the slip carrier; and d. means for attaching the slips to the slip carrier and the slip expander whereby longitudinal movement of the slip expander towards the slip carrier radially projects the slips to place the anchoring means in its expanded position and longitudinal movement of the slip carrier away from the slip expander radially retracts the slips to place the anchoring means in its retracted position.

5. A well packer as defined in claim 4 further comprising:

a. a collet cylinder with the mandrel means slidably disposed therein;

b. means for connecting the collet cylinder to the internal slip housing means to prevent relative movement therebetween;

c. collet fingers having collet heads on one end which can be releasably engaged with the collet cylinder; and d. means for connecting the other end of the collet fingers to the slip carrier whereby engagement of the collet fingers with the collet cylinder prevents undesired longitudinal movement of the slip carrier relative to the mandrel means.

6. A well packer as defined in claim 5 further comprising an enlarged outside diameter portion on the other mandrel means which maintains engagement of the collet fingers with the collet cylinder when positioned adjacent thereto.

7. A well packer as defined in claim 6 further comprising:

a. means for restricting upward longitudinal movement of the other mandrel means relative to the one mandrel means when the anchoring means is in its expanded position until after a predetermined amount of tension has been applied to the other mandrel means; and b. a shoulder positioned on the exterior of the other mandrel means to engage the slip carrier and to move the slip carrier longitudinally away from the slip expander as the other mandrel means moves longitudinally upward relative to the one mandrel means.

8. A well packer as defined in claim 7 wherein the restricting means further comprises a plurality of shear means to releasably attach the collet fingers to the other mandrel means.

9. A well packet as defined in claim 8 further comprising a retrieving collar securely engaged to the other mandrel means and spaced longitudinally below the setting collar.

10. A well packet for forming a downhole fluid barrier between a casing string and a pair of tubing strings disposed therein comprising:

a. a pair of parallel mandrel means with a longitudinal flow passageway extending through each mandrel means;

b. means for connecting each mandrel means to separate tubing strings to allow fluid communication through each mandrel means and its associated tubing string;

c. packing means carried on the exterior of the mandrel means whereby compression of the packing means causes radial expansion thereof to form the fluid barrier;

d. anchoring means carried on the exterior of the mandrel means having a retracted position and an expanded position whereby the anchoring means is releasably engageable with the interior of the casing string to prevent undesired movement of the well packer relative to the casing string;

e. means for releasably securing the mandrel means to each other to prevent relative longitudinal movement therebetween until after the well packer is lowered to its desired downhole location;

f. means for moving the anchoring means to its expanded position and compressing the packing means in response to upward longitudinal movement of one mandrel means;

g. means for anchoring means to its retracted position and releasing compression of the packing means in response to upward longitudinal movement of the other mandrel means.

h. the anchoring means including a slip carrier, slips and a slip expander; and i. means for restricting longitudinal movement of the slip carrier relative to the other mandrel means while setting the well packer.

11. A well packer as defined in claim 10 wherein the restricting means comprises:

a. a collet cylinder carried by and surrounding a portion of the mandrel means above the anchoring means;

b. a plurality of collet fingers around the exterior of the other mandrel means;

c. a collet head on one end of each collet finger and an internal recess in the collet cylinder sized to receive the collet heads therein; and d. means for engaging the collet fingers to the slip carrier.

12. A well packer as defined in claim 11 further comprising an enlarged outside diameter portion on the other mandrel means which maintains engagement of the collet fingers with the collet cylinder when positioned adjacent thereto.

13. A well packer as defined in claim 10 further comprising:

a. a setting collar carried on the exterior of the mandrel means below the packing means;

b. means for firmly engaging the setting collar to the one mandrel means;

c. means for releasably engaging the setting collar to the other mandrel means;

d. the setting collar providing a portion of the means for releasably securing the mandrel means to each other; and e. the setting collar providing a portion of the means for compressing the packing means and moving the anchoring means to its expanded position.

14. A well packer as defined in claim 10 further comprising:

a. internal slip housing means;

b. both mandrel means slidably disposed within the housing means;

c. internal slips carried by the housing means around the exterior of the one mandrel means; and d. the housing means and its internal slips cooperating to allow only upward longitudinal movement of the one mandrel means relative to the other mandrel means.

* * * * *